US012553318B1

(12) United States Patent
Moreno

(10) Patent No.: US 12,553,318 B1
(45) Date of Patent: Feb. 17, 2026

(54) PILOT AMPLIFIED AUTONOMOUS FLOW CONTROL CONFIGURATION, METHOD, AND SYSTEM

(71) Applicant: Baker Hughes Oilfield Operations LLC, Houston, TX (US)

(72) Inventor: Oscar Becerra Moreno, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/978,967

(22) Filed: Dec. 12, 2024

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS 11,131,161 B2 * 9/2021 Fripp ..... E21B 43/12
2014/0041731 A1 * 2/2014 Fripp ..... E21B 43/12
137/13
2021/0002978 A1 * 1/2021 Killie ..... E21B 43/12
2022/0341290 A1 * 10/2022 Fripp ..... G01V 3/28
2023/0117274 A1 * 4/2023 Moreno ..... E21B 34/12
166/373
2023/0121280 A1 * 4/2023 Moreno ..... G05D 7/0146
166/373
2024/0271509 A1 * 8/2024 Rudic ..... E21B 43/12
2025/0003318 A1 * 1/2025 Younger ..... E21B 43/12

* cited by examiner

*Primary Examiner* — Shane Bomar
(74) *Attorney, Agent, or Firm* — Baker Hughes Patent Organization

(57) ABSTRACT

A pilot amplified autonomous flow control configuration, including a flow control device having an inlet and an outlet, a pilot having an inlet connected to a source of fluid to which the device inlet is connected, the pilot comprising a first chamber having a first rotatable block, the first block having a specific gravity greater than oil and less than water, a port with a plurality of ports extending through the port wall, the first block rotating based upon density of fluid in the chamber to block some of the plurality of ports while leaving others of the plurality of ports open. A method for controlling flow in a borehole including running and allowing a configuration to self orient, and controlling flow.

12 Claims, 7 Drawing Sheets

A–A Water restrictor pivot

B–B Nozzles Assembly

C–C Gravity orientation pivot

PILOT AMPLIFIED AUTONOMOUS FLOW CONTROL CONFIGURATION, METHOD, AND SYSTEM

BACKGROUND

In the resource recovery and fluid sequestration industries, it is often necessary to manage fluid flows. It is particularly useful to be able to manage flows of different fluids automatically to enhance the overall operation. Drawbacks in the industry leave room for improvement and varying operating conditions render certain constructions superior to others for specific circumstances. Hence, the art is always receptive to new configurations.

SUMMARY

An embodiment of a pilot amplified autonomous flow control configuration, including a flow control device having a device inlet and a device outlet, a pilot having an inlet connected to a source of fluid to which the device inlet is connected, the pilot comprising a first chamber wherein a first rotatable block is positioned, the first block having a specific gravity greater than oil and less than water, a port wall defining a portion of the chamber, wherein a plurality of ports extend through the port wall, the first block rotating based upon density of fluid in the chamber to block some of the plurality of ports while leaving others of the plurality of ports open.

An embodiment of a method for controlling flow in a borehole including running a configuration, into a borehole, allowing the configuration to self orient, and controlling flow based upon fluid makeup.

An embodiment of a borehole system, including a borehole in a subsurface formation, a string in the borehole, and a configuration, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
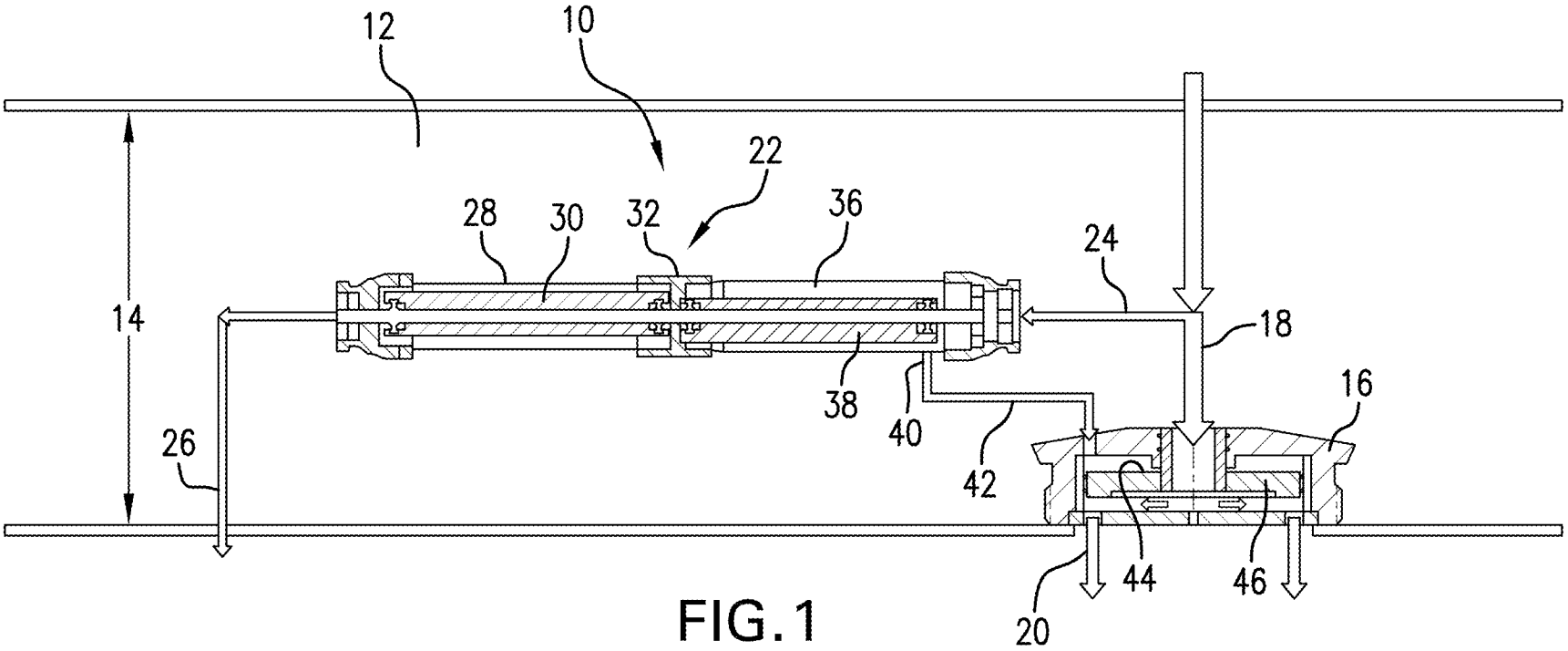
FIG. 1 is a schematic quarter sectional view of a housing having a pilot amplified autonomous flow control configuration therein.

Referring to FIG. 1, a schematic quarter sectional view of a pilot amplified autonomous flow control configuration 10 disposed in a housing 12 is illustrated. The housing 12 may be a part of a tubular member that may be just a tubular or may also include other components of a tool. Hence it is to be understood that the configuration 10 may be a part of another tool. The configuration 10 is disposed within a wall thickness 14 of the housing 12 in some embodiments. Configuration 10 includes a flow control device 16 having a device inlet 18 and a device outlet 20. The device 16 may be an inflow control device and may be responsive to density, viscosity, or both of fluid flowing therethrough to automatically tend to choke undesired fluids that have crept into a fluid stream coming through the device 16. In some embodiments water might become entrained with an oil that is the object of a production well. Obviously, water production is undesirable and counterproductive, so a device 16 that automatically tends to choke the flow if water become part of the flow is desirable. The device 16 is autonomous in nature but requires a substantial amount of the undesired fluid before significantly choking the flow. Autonomous choking can be improved as taught herein by combining the function of the device 16 with the rest of the components of the configuration 10.

Figure 2:
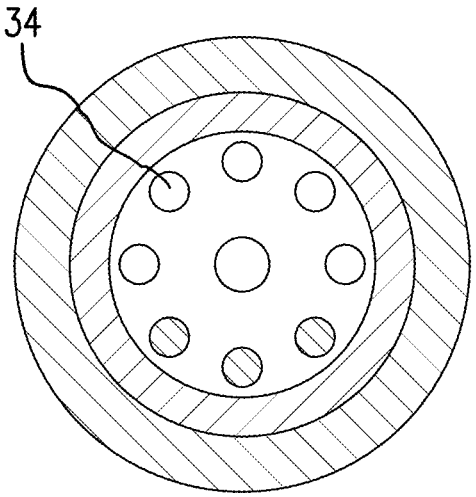
FIG. 2 is a sectional view of the pilot taken along section line 2-2 with the pilot in the open condition.
Figure 3:
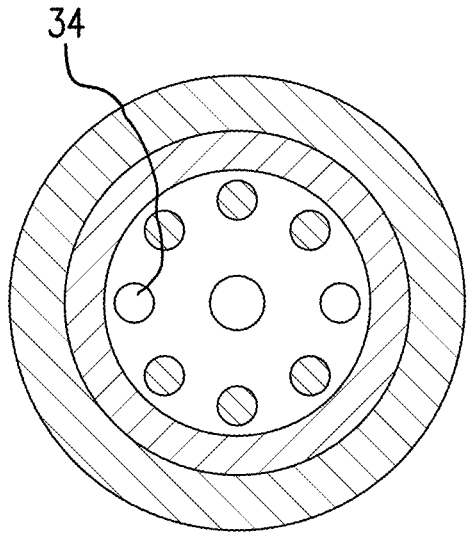
FIG. 3 is a sectional view of the pilot taken along section line 3-3 with the pilot in the closed condition.

Configuration 10 further includes a pilot 22 comprising a pilot inlet 24 and a pilot outlet 26. The pilot inlet 24 is fluidly connected to the same source of fluid as is the device inlet 18. Within the pilot 22 is a first chamber 28 having a rotatable block 30 therein. Rotatable block 30 has a specific gravity between the specific gravity of the desired production fluid and the likely undesirable fluid. In an embodiment the desirable fluid is oil and the undesirable fluid is water. Accordingly, the specific gravity of block 30 is between the specific gravity of water, which is 1 and the specific gravity of a target type of oil. In a particular embodiment the specific gravity of the block 30 is 0.88. Block 30 is positioned adjacent a port wall 32 having a plurality of ports 34. As illustrated, there are 8 ports but more or fewer are contemplated. FIGS. 2 and 3 illustrate the block 30 and the port wall 32 in a flow open position and flow closed position, respectively. In an embodiment, the pilot 22 comprises a second chamber 36 in part defined by the same port wall 32. The second chamber 36 includes a second rotatable block 38 that again is responsive to gravity for orientation and to fluid flowing there in however second block 38 is of a specific gravity of greater than both of the anticipated fluids in the system. For the Example of oil and water, the specific gravity of the second block is 1.1. Second block hence sinks in both oil and water. This position ensures that ports 34 that are on the "bottom" with respect to gravity, will always be closed to fluid flow by the second block 38. The "upper" ports, again based upon a direction of gravity, will be open with respect to the second block 38 but may be open or closed based upon the position of first block 30.

When an undesirable fluid is flowing through the configuration 10, such as water for example, the first block 30 will rotate by floating on the water and close the ports 34 as illustrated in FIG. 3. This position substantially reduces flow through the pilot 22. It is important to note that the position does not eliminate flow since if that were the case, the pilot would work only once. Allowing a small amount of fluid to pass through the pilot 22 means that the pilot can reopen if conditions improve with respect to the type of fluid flowing therethrough. Regardless of the small amount of fluid still flowing through the pilot 22, the substantial closure of the fluid pathway through ports 34 by first block 30 rotating to obscure the ports 34 also causes pressure in the second chamber 36 to rise. Second chamber further includes a pressure tap 40 that is ported via a conduit 42 to a back side 44 of a piston or float disk 46 of the device 16 so that higher pressure generated in second chamber 36 will tend to urge the device 16 to a more closed position. This effectively amplifies a "signal" of an undesirable fluid flowing through the configuration 10 and actively urges the device 16 to a more closed or choked position, reducing the flow of the undesirable fluid.

Due to the rotatability of the blocks 30 and 38, and to the structural considerations of the first and second chambers 28 and 36, respectively, the configuration is position agnostic. It will find its own position relative to gravity and perform the function as described above.

Figure 4:
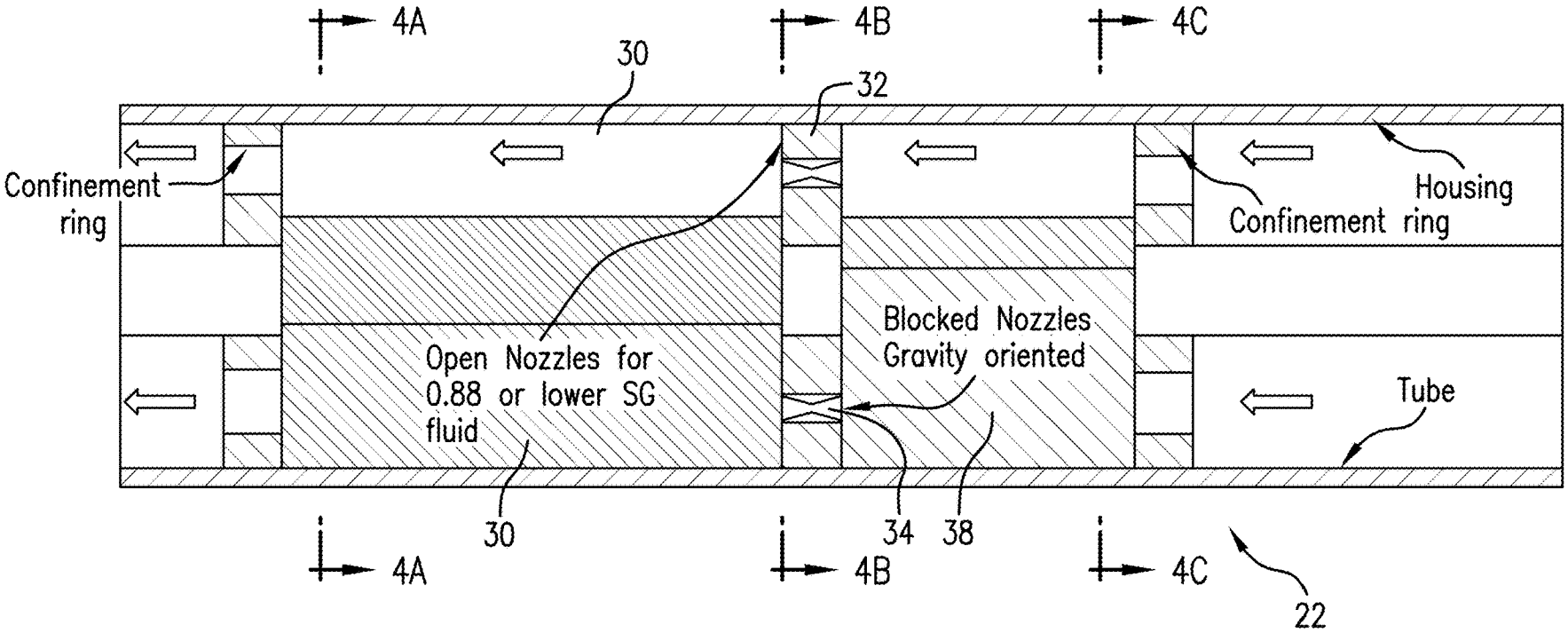
FIG. 4 is an enlarged view of the pilot in an open condition.
Figure 4C:
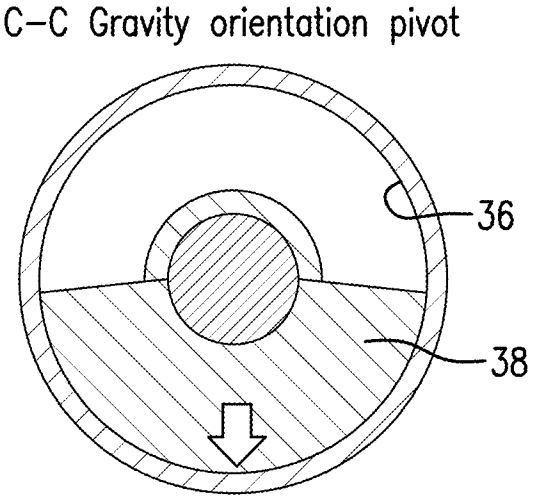
FIGS. 4A-4C are sectional views taken along section lines 4A-4A, 4B-4B, and 4C-4C, respectively in FIG. 4.
Figure 4B:
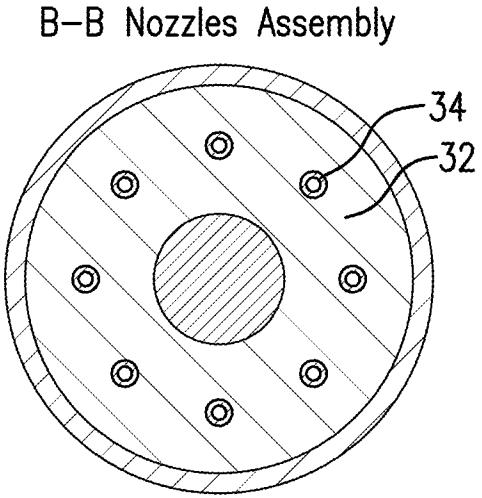
Figure 4A:
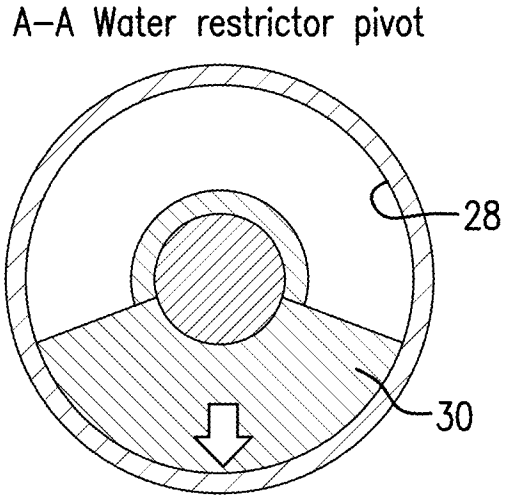
Figure 5:
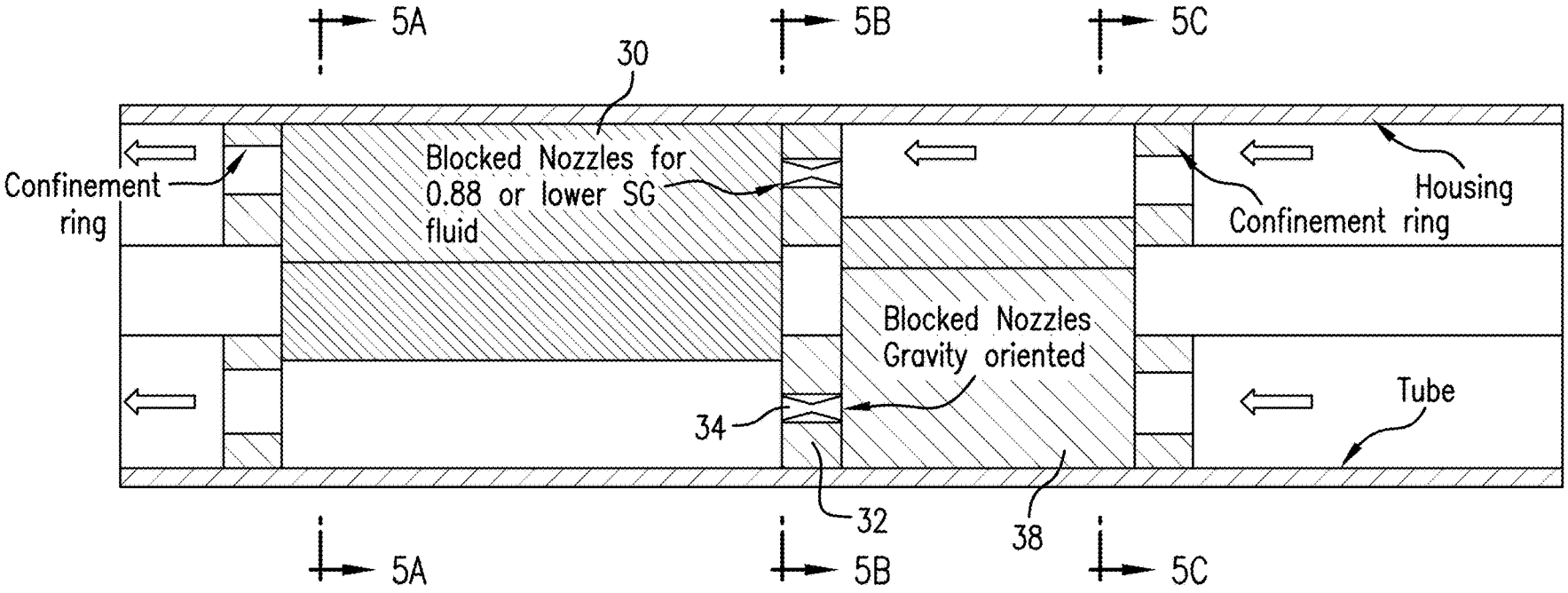
FIG. 5 is an enlarged view of the pilot in a closed condition.
Figure 5A:
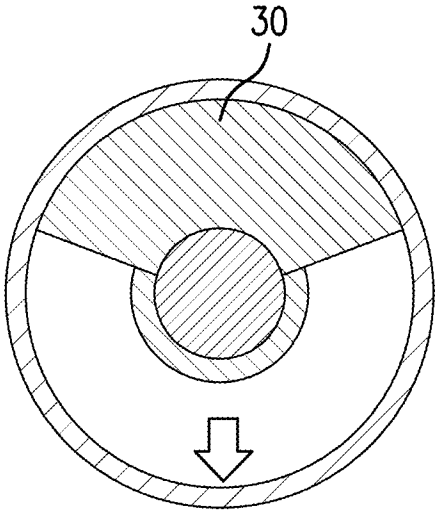
FIGS. 5A-5C are sectional views taken along section lines 5A-5A, 5B-5B, and 5C-5C, respectively in FIG. 5.
Figure 5B:
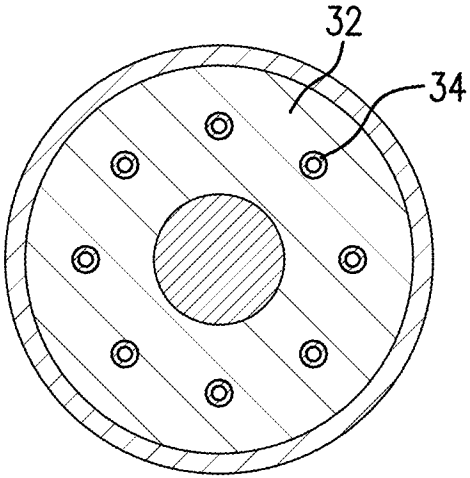
Figure 5C:
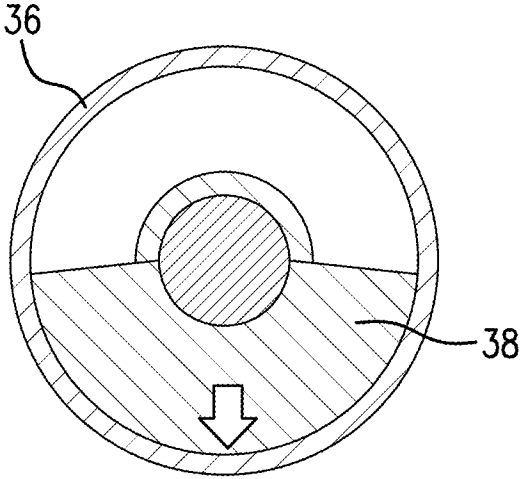

In order to enhance understanding of the disclosed configuration, FIGS. 4 and 5 along with their cross section al subfigures are provided in a large format. Each of the descriptions above can be read on to these figures using the same numerals.

Figure 6:
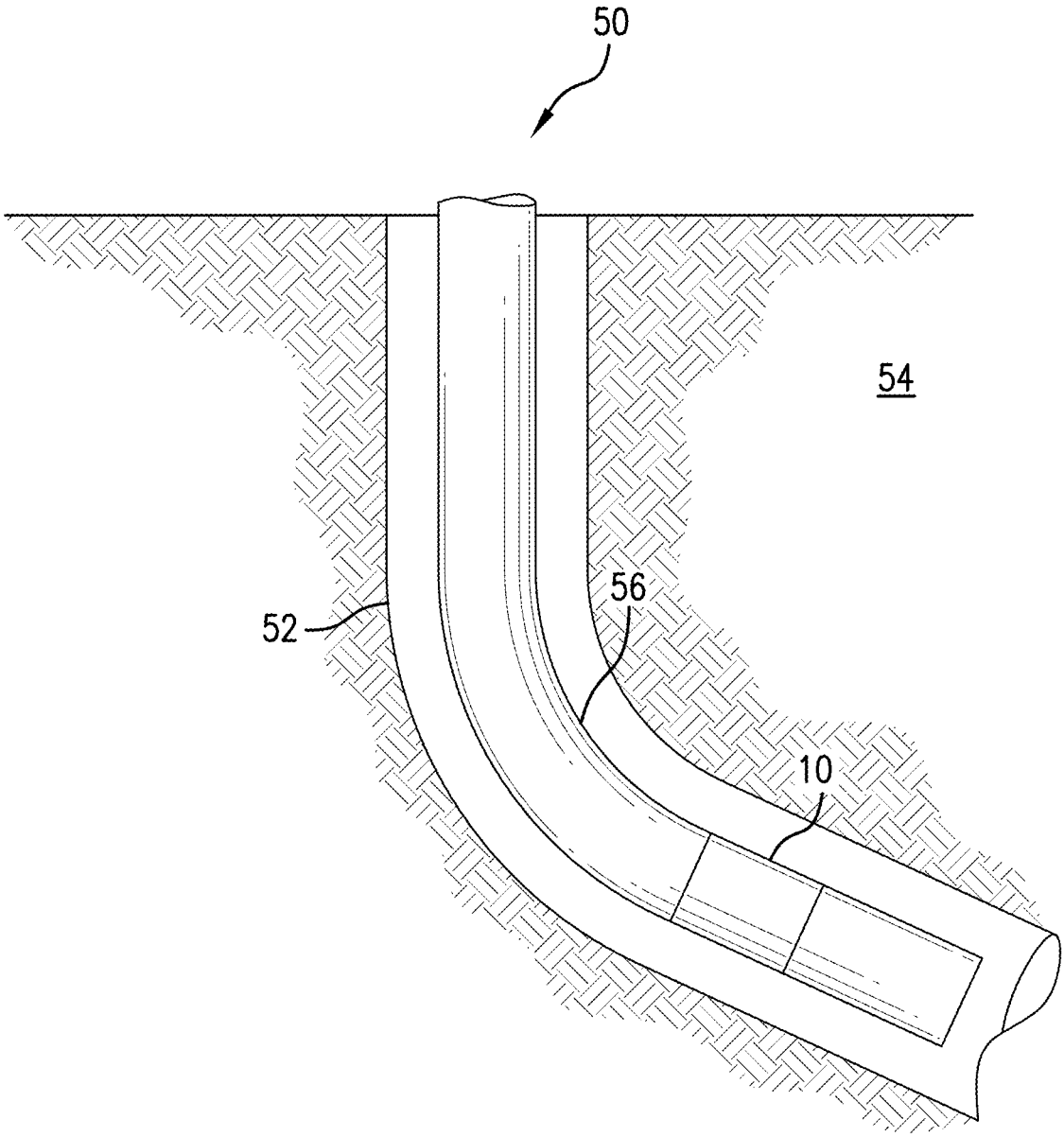
FIG. 6 is a view of a borehole system including the pilot amplified autonomous flow control configuration as disclosed herein.

Referring to FIG. 6, a borehole system 50 is illustrated. The system 50 comprises a borehole 52 in a subsurface formation 54. A string 56 is disposed within the borehole 52. A configuration 10 as disclosed herein is disposed within or as a part of the string 56.

Set forth below are some embodiments of the foregoing disclosure:

Embodiment 1: A pilot amplified autonomous flow control configuration, including a flow control device having a device inlet and a device outlet, a pilot having an inlet connected to a source of fluid to which the device inlet is connected, the pilot comprising a first chamber wherein a first rotatable block is positioned, the first block having a specific gravity greater than oil and less than water, a port wall defining a portion of the chamber, wherein a plurality of ports extend through the port wall, the first block rotating based upon density of fluid in the chamber to block some of the plurality of ports while leaving others of the plurality of ports open.

Embodiment 2: The configuration as in any prior embodiment, wherein the flow control device is responsive to viscosity, density, or both of a fluid flowing therethrough.

Embodiment 3: The configuration as in any prior embodiment, wherein the pilot includes a second chamber defined in part by the port wall, the second chamber housing a second rotatable block having a specific gravity greater than oil and greater than water.

Embodiment 4: The configuration as in any prior embodiment, wherein the second chamber includes a pressure tap connected to the flow control device whereby pressure in the second chamber has an effect on the flow control device.

Embodiment 5: The configuration as in any prior embodiment, wherein the pressure is ported to a back side of a floating piston of the flow control device to urge the floating piston toward a closed position of the flow control device.

Embodiment 6: The configuration as in any prior embodiment, wherein the pressure in the second chamber rises when water is encountered as a result of the first block closing ports of the port wall.

Embodiment 7: The configuration as in any prior embodiment, wherein the pilot is self orienting to gravity.

Embodiment 8: A method for controlling flow in a borehole including running a configuration as in any prior embodiment, into a borehole, allowing the configuration to self orient, and controlling flow based upon fluid makeup.

Embodiment 9: The method as in any prior embodiment, further comprising biassing the flow control device to a closed position with pressure in the pilot based upon pressure rising when water is encountered as a result of the first block closing ports of the port wall.

Embodiment 10: A borehole system, including a borehole in a subsurface formation, a string in the borehole, and a configuration as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A pilot amplified autonomous flow control configuration, comprising:

a flow control device having a device inlet and a device outlet;

a pilot having an inlet connected to a source of fluid to which the device inlet is connected, the pilot comprising:

a first chamber wherein a first rotatable block is positioned, the first block having a specific gravity greater than oil and less than water, the block configured to find its own position relative to gravity, during use;

a port wall defining a portion of the chamber, wherein a plurality of ports extend through the port wall, the first block rotating based upon density of fluid in the chamber to block some of the plurality of ports while leaving others of the plurality of ports open.

2. The configuration as claimed in claim 1, wherein the flow control device is responsive to viscosity, density, or both of a fluid flowing therethrough.

3. The configuration as claimed in claim 1, wherein the pilot includes a second chamber defined in part by the port wall, the second chamber housing a second rotatable block having a specific gravity greater than oil and greater than water.

4. The configuration as claimed in claim 3, wherein the second chamber includes a pressure tap connected to the flow control device whereby pressure in the second chamber has an effect on the flow control device.

5. The configuration as claimed in claim 4, wherein the pressure is ported to a back side of a floating piston of the flow control device to urge the floating piston toward a closed position of the flow control device.

6. The configuration as claimed in claim 4, wherein the pressure in the second chamber rises when water is encountered as a result of the first block closing ports of the port wall.

7. The configuration as claimed in claim 1, wherein the pilot is self orienting to gravity.

8. A method for controlling flow in a borehole comprising:

running a configuration as claimed in claim 1 into a borehole;

allowing the configuration to self orient; and controlling flow based upon fluid makeup.

9. The method as claimed in claim 8, further comprising biassing the flow control device to a closed position with pressure in the pilot based upon pressure rising when water is encountered as a result of the first block closing ports of the port wall.

10. A borehole system, comprising:

a borehole in a subsurface formation;

a string in the borehole; and a configuration as claimed in claim 1 disposed within or as a part of the string.

11. A pilot amplified autonomous flow control configuration, comprising:

a flow control device having a device inlet and a device outlet;

a pilot having an inlet connected to a source of fluid to which the device inlet is connected, the pilot comprising:

a first chamber wherein a first rotatable block is positioned, the first block having a specific gravity greater than oil and less than water;

a port wall defining a portion of the chamber, wherein a plurality of ports extend through the port wall, the first block rotating based upon density of fluid in the chamber to block some of the plurality of ports while leaving others of the plurality of ports open, the pilot further comprising:

a second chamber defined in part by the port wall, the second chamber housing a second rotatable block having a specific gravity greater than oil and greater than water, wherein the second chamber includes a pressure tap connected to the flow control device whereby pressure in the second chamber has an effect on the flow control device; and wherein the pressure is ported to a back side of a floating piston of the flow control device to urge the floating piston toward a closed position of the flow control device.

12. A pilot amplified autonomous flow control configuration, comprising:

a flow control device having a device inlet and a device outlet;

a pilot having an inlet connected to a source of fluid to which the device inlet is connected, the pilot comprising:

a first chamber wherein a first rotatable block is positioned, the first block having a specific gravity greater than oil and less than water;

a port wall defining a portion of the chamber, wherein a plurality of ports extend through the port wall, the first block rotating based upon density of fluid in the chamber to block some of the plurality of ports while leaving others of the plurality of ports open, the pilot further comprising:

a second chamber defined in part by the port wall, the second chamber housing a second rotatable block having a specific gravity greater than oil and greater than water, wherein the second chamber includes a pressure tap connected to the flow control device whereby pressure in the second chamber has an effect on the flow control device; and wherein the pressure in the second chamber rises when water is encountered as a result of the first block closing ports of the port wall.

* * * * *